US007373883B1

(12) United States Patent
Gieseke

(10) Patent No.: US 7,373,883 B1
(45) Date of Patent: May 20, 2008

(54) PROJECTILE WITH TAIL-MOUNTED GAS GENERATOR ASSEMBLY

(75) Inventor: Thomas J. Gieseke, Newport, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 438 days.

(21) Appl. No.: 11/040,296

(22) Filed: Jan. 10, 2005

(51) Int. Cl.
*F42B 15/20* (2006.01)

(52) U.S. Cl. ..... 102/399

(58) Field of Classification Search ..... 114/20.1, 114/20.2; 102/341, 374, 381, 399
See application file for complete search history.

(56) References Cited

U.S. PATENT DOCUMENTS 1,333,199 A * 3/1920 Barthelrmy ..... 102/398
3,016,865 A * 1/1962 Eichenberger ..... 114/67 A
3,096,739 A 7/1963 Smith
3,150,625 A 9/1964 Brooks
3,205,846 A * 9/1965 Lang ..... 114/67 A
3,323,457 A * 6/1967 Biehl et al. ..... 102/399
4,623,107 A * 11/1986 Misoph ..... 244/3.22
4,674,707 A * 6/1987 Kranz ..... 244/3.22
5,070,761 A * 12/1991 Fidler ..... 89/1.809
5,929,370 A 7/1999 Brown et al.
6,405,653 B1 * 6/2002 Miskelly ..... 102/374
6,739,266 B1 * 5/2004 Castano et al. ..... 102/399
6,962,121 B1 * 11/2005 Kuklinski ..... 114/67 A

* cited by examiner

*Primary Examiner*—Andrew J. Fischer
*Assistant Examiner*—Jamie Kucab
(74) *Attorney, Agent, or Firm*—James M. Kasischke; Michael P. Stanley; Jean-Paul A. Nasser

(57) ABSTRACT

A projectile is provided that includes a body having a front tip portion and a rear end portion. A combustion chamber base plate is operatively arranged with the rear end portion of the body and defines a combustion chamber. At least one radial discharge aperture is partially defined by the combustion chamber base plate and is arranged in fluid communication with the combustion chamber. A gas generated by igniting a combustible material is discharged through the at least one radial discharge aperture. The discharged gas impinges against a wall of a cavity formed by the moving projectile to form a reactive force that stabilizes the projectile thereby reducing the occurrence of tail-slap.

1 Claim, 2 Drawing Sheets

PROJECTILE WITH TAIL-MOUNTED GAS GENERATOR ASSEMBLY

STATEMENT OF GOVERNMENT INTEREST

The teachings described herein may be manufactured and used by or for the Government of the United States of America for governmental purposes without the payment of any royalties thereon or therefore.

BACKGROUND OF THE INVENTION (1) Field of the Invention

The present teachings relate to an underwater projectile for neutralizing undersea targets from a relatively long range. More particularly, the present teachings relate to the tail or end portion of a supercavitating projectile and to arrangements and methods for emitting gases from the end portion to stabilize the projectile and reduce viscous drag.

(2) Description of the Prior Art

Projectiles fired from underwater guns can effectively travel large distances by making use of supercavitation. Supercavitation occurs when a body, such as a projectile, travels through water at a relatively high-speed and a vaporous cavity begins to form at its tip. With proper projectile design, a vaporous cavity envelops the entire projectile.

In FIG. 1, a known supercavitating projectile 10 is shown in which a vaporous cavity 12 surrounds the projectile 10. The projectile 10 is shown with a flared afterbody 16 emitted from its tail portion. As the projectile 10 attains relatively high-speeds, the projectile does not contact water except at a cavitator tip 14 and during occasional collisions with the walls of the vaporous cavity 12, referred to as tail-slap. As a result of the formation of the vaporous cavity 12, a viscous drag on the projectile can be significantly reduced compared to a fully-wetted operation.

Tail-slap is relevant both to the stabilization of projectiles and to the minimization of drag. When traveling at relatively small angles of attack, supercavitating projectiles generally do not contact the vaporous cavity except at the tip of the projectile, as shown in FIG. 1. Forces produced by the tip are generally aligned with the major axis of the projectile and no significant yaw forces are produced. However, if the body of the projectile is perturbed and begins to yaw, substantially no restoring forces are experienced until the flared afterbody comes into contact with the cavity wall. When this occurs, a restoring force substantially proportional to the angle of the emitted flare can be produced. This restoring force can push the projectile back in the opposite direction and the projectile will then yaw in the other direction until the cavity wall on the opposite side is impacted. This rattling back and forth is the basic stabilization mechanism of non-finned projectiles. Every time the projectile impacts the cavity wall it experiences a drag force and a bending moment. If the bending moment is large enough, the projectile can break in flight.

Another related concern with the operation of projectiles is the issue of depth and speed with respect to the generation to form and the size of the cavity is a function of the speed of the projectile and the size of the cavitator tip. As the projectile begins to travel down-range, it begins to slow due to drag generated at the tip, resulting in the size of the cavity shrinking. The cavity continues to shrink as the projectile decelerates until the cavity can no longer envelop the entire projectile. The water pressure surrounding the projectile can also influence the operation of the projectile. The size of the cavity is inversely proportional to the ambient pressure. Consequently, projectiles are incapable of traveling the same distance at a greater depth compared to a shallower depth.

It is known that enlarging the cavitation bubble surrounding an underwater projectile reduces hydrodynamic drag. In Miskelly (U.S. Pat. No. 6,405,653) a projectile is disclosed that includes an internal ventilation system for venting propellant combustion gases to an exterior of the projectile near the front or nose portion thereof. The vented combustion gases emitted from the nose portion serve to expand the naturally occurring cavitation bubble formed as the projectile travels through the water with the result of reducing hydrodynamic drag. However, the Miskelly reference does not disclose a way of eliminating the occurrence of tail-slap during travel of the projectile.

As such, a need continues to exist for eliminating or reducing the occurrence of tail-slap in projectiles. There also exists a need to achieve improved accuracy and stability and to extend the range of projectiles.

SUMMARY OF THE INVENTION

In order to address the needs described above, the present teachings disclose a projectile comprising a body including a front tip portion and a rear end portion. A combustion chamber base plate is operatively arranged with the rear end portion of the body and defines a combustion chamber. A combustible material is placed in the combustion chamber. At least one radial discharge aperture is partially defined by the combustion chamber base plate and is in fluid communication with the combustion chamber. A gas generated by igniting the combustible material discharges through the at least one radial discharge aperture.

The present teachings also provide a projectile comprising a body including a front tip portion and a rear end portion, and a gas generator assembly operatively arranged with the rear end portion of the body. The gas generator assembly defines a combustion chamber and at least one radial discharge aperture arranged in fluid communication with the combustion chamber. The gas generator assembly can include a combustible material arranged in the combustion chamber. A gas generated by igniting the combustible material discharges through the at least one radial discharge aperture.

The present teachings also provide a method of stabilizing a moving projectile. The method provides a gas generator assembly on a rear end portion of a projectile. The gas generator assembly defines at least one radial discharge aperture that can be arranged in fluid communication with a combustion chamber. A gas is generated by igniting a combustible material arranged in the combustion chamber and is discharged from the combustion chamber through the least one radial discharge aperture to an area that is exterior to the body of the projectile. The discharged gas is directed to impinge against a wall of a cavity formed by the moving projectile to form a reactive force that stabilizes the projectile.

By discharging a gas at the rear portion of the projectile, the occurrence of tail-slap can be reduced or eliminated. Moreover, improved accuracy and stability, and an extended range can be achieved.

Additional features and advantages of various embodiments will be set forth in part in the description that follows, and in part will be apparent from the description, or may be learned by practice of various embodiments. The objectives and other advantages of various embodiments will be realized and attained by means of the elements and combinations particularly pointed out in the description herein.

It is to be understood that both the foregoing general description and the following detailed description are exemplary and explanatory only, and are intended to provide an explanation of various embodiments of the present teachings.

DESCRIPTION OF THE PREFERRED EMBODIMENT

Underwater gun systems can be used as anti-mine and anti-torpedo devices. Such gun systems can be composed of, for example, underwater projectiles, an underwater gun, a ship-mounted turret, a targeting system, and/or a combat system. The underwater gun can be arranged to shoot projectiles that are designed to neutralize undersea targets from relatively long range, such as, for example, from about 200m. The undersea targets can be identified and localized by way of specialized targeting systems. Moreover, the targeting systems can provide the control commands for directing the ship-mounted turret to point the underwater gun towards the targets. The present teachings provide a projectile that can be used with an underwater gun system, or the like, having an improved accuracy and stability, and an extended range. The present teachings can be applied to and encompass other airborne or underwater devices, self-propelled or not self-propelled, such as, torpedoes, bullets, missiles, rockets, bombs, and shells.

Figure 1:
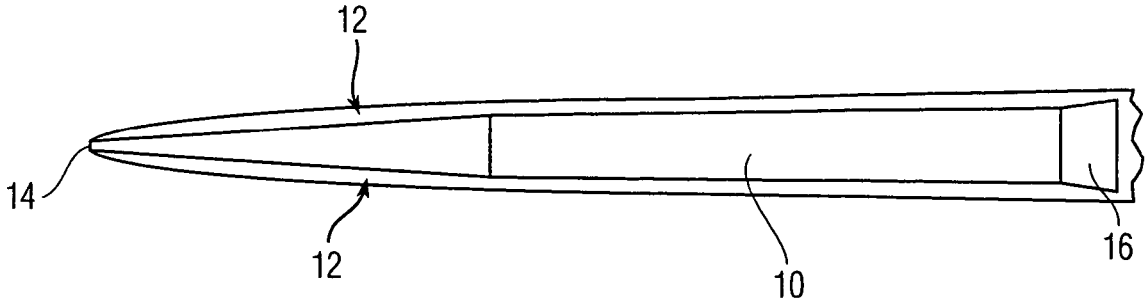
PRIOR ART FIG. 1
FIG. 1 is a side view of a supercavitating projectile known in the art as the supercavitating projectile travels through a fluid.
Figure 2:
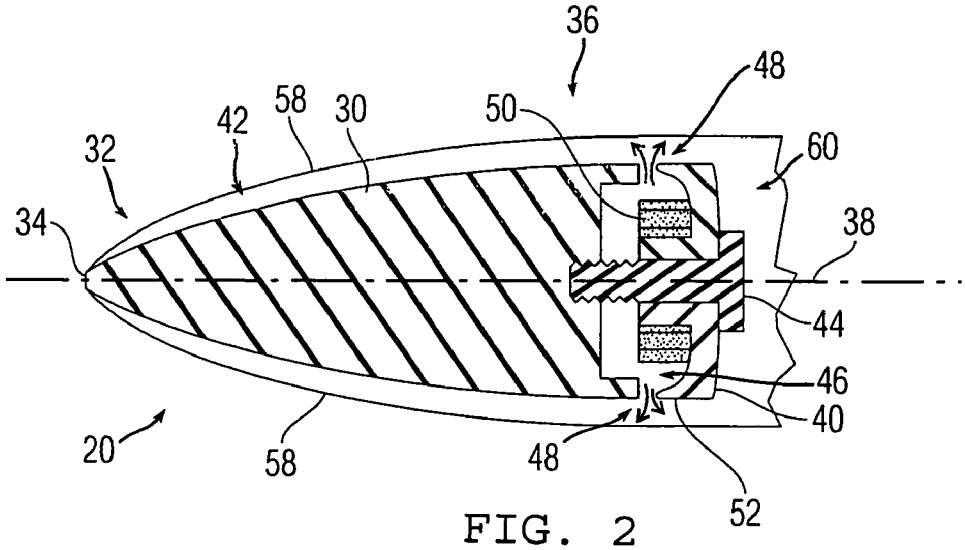
FIG. 2 is a side cross-sectional view of a projectile of the present invention in which the projectile includes a gas generator assembly arranged at a rear end portion of the projectile.

In FIG. 2, a projectile 20 of the present invention is shown in which the projectile includes a body 30 having a front tip portion 32 and a rear end portion 36. The front tip portion 32 tapers inwardly towards the forward end of the projectile and terminates at a nose 34. The nose 34 can be formed with a cavitator tip that operates to form a cavity around the projectile 20 as it travels through a fluid. The cavity begins to form as water flows around the nose 34 of the projectile 20. The shape of the cavitator tip causes the pressure around the nose 34 to decrease below that of the vapor pressure of the water resulting in the formation of the cavity or bubble in which the projectile 20 can travel. FIG. 2 shows the formation of a cavity 42, for example, a vaporous cavity, that encompasses the entire projectile 20. From the front tip portion 32 and extending rearwardly, the body 30 can begin to generally form a cylindrical housing that can terminate at the rear end portion 36. A longitudinal axis 38 of the projectile 20 bisects the nose 34 and extends through the middle of the body 30. In FIG. 2, the longitudinal axis 38 of the projectile 20 coincides with an ideal straight-line direction of travel of the projectile 20.

According to various embodiments, the body 30 of the projectile 20 can be formed of any suitable material, such as, for example, steel or any other metallic or non-metallic material. The body 30 can be partially or substantially entirely hollow, or can be an entirely or substantially entirely solid structure.

A gas generator assembly 60 is arranged at the rear end portion 36 of the body 30 of the projectile 20. The gas generator assembly 60 includes a combustion chamber base plate 40 that is directly or indirectly fastened to the body 30 of the projectile 20. For example, the combustion chamber base plate 40 is fastened to the body 30 by way of a screw fastener 44. Other attachment mechanisms can include, for example, clamps, rivets, locks, adhesives, or combinations thereof. According to various embodiments, the combustion chamber base plate 40 can be formed of any suitable material, such as, for example, steel or any other metallic or non-metallic material.

The gas generator assembly 60 according to various embodiments can be retrofitted onto known projectile bodies. In the case of self-propelled projectiles, the gas generator assembly 60 can be arranged or designed to avoid interfering with the propulsion system of the projectile. The combustion chamber base plate 40 of the gas generator assembly 60 can be formed as an integral, one-piece structure with the body 30 of the projectile 20.

The combustion chamber base plate 40 defines a combustion chamber 46 and at least one radial discharge aperture 48. According to various embodiments, the combustion chamber 46 is arranged in fluid communication with the at least one radial discharge aperture 48. The at least one radial discharge aperture 48 is arranged to discharge to an area that is exterior to the body 30 and at a substantially rear end portion 36 thereof.

Figure 3:
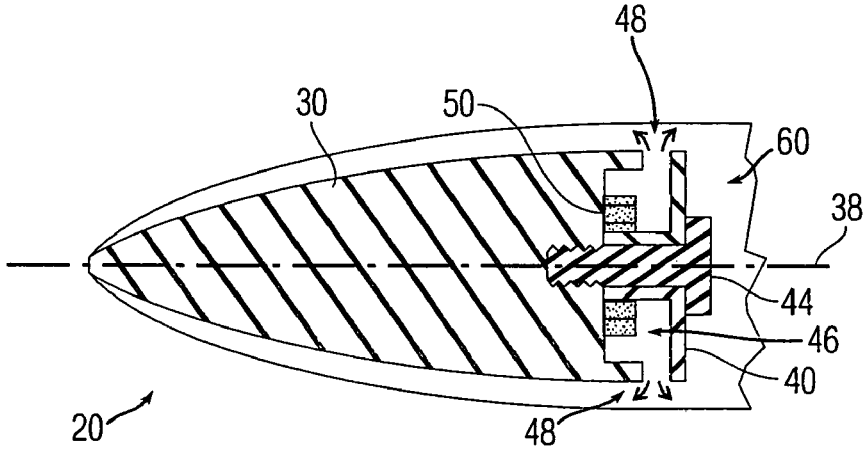
FIG. 3 is a side cross-sectional view of a projectile of the present invention in which the projectile includes a combustion chamber of a gas generator assembly arranged within a body of the projectile.

The combustion chamber 46 is partially defined by the combustion chamber base plate 40. The rear end portion 36 of the body 30 also defines a portion of the combustion chamber 46, as shown in FIG. 2. The combustion chamber 46 can be formed as a unitary, continuous annular chamber or can include one or more chambers of varying shapes and sizes. In another embodiment, the combustion chamber 46 is entirely defined or formed by the combustion chamber base plate 40 as being within the body 30, as shown in FIG. 3.

A combustible material 50 arranged in the combustion chamber 46 can be a solid propellant of any suitable composition that is capable of being ignited and generating a gas. Alternatively, the combustible material 50 can be a liquid propellant that is capable of being ignited and generating a gas. The combustible material 50 shown is shaped as an annular ring that fits in a correspondingly-shaped annular combustion chamber 46. The combustible material 50 is retained in the combustion chamber 46 and securely held in place with the fastener 44.

Referring to FIG. 2, at least one radial discharge aperture 48 is partially defined by the combustion chamber base plate 40. The at least one radial discharge aperture 48 is formed between the rear end portion 36 of the body 30 and the combustion chamber base plate 40. As shown in the FIG., the radial discharge aperture 48 is defined by an edge portion 52 of the combustion chamber base plate 40 and the circumferential rear end portion 36 of the body 30.

The radial discharge aperture 48 can be formed as a continuous annular slot or can include a plurality of discrete discharge apertures. The plurality of discrete discharge apertures can be arranged circumferentially around the rear end portion 36 of the body 30. The plurality of discharge apertures can be spaced equidistantly from each other or staggered at various distances along the circumference of the body 30. The discrete discharge apertures can be generally circular or oval in shape, or can be any other shape, such as a square or rectangular shape. According to various embodiments, the at least one radial discharge aperture 48 can be entirely defined or formed by the combustion chamber base plate 40.

The at least one radial discharge aperture 48 can be arranged to open in a direction that is substantially perpendicular to the longitudinal axis 38 of the projectile 20. At launch or during travel, the combustible material 50 is ignited by way of any known ignition mechanism. The ignition of the combustible material 50 results in the generation of a high pressure gas that is discharged in a generally radially outwardly direction through the at least one radial discharge aperture 48.

The discharge of gas through the at least one radial discharge aperture 48 at the rear of the projectile 20 provides a stabilizing effect on the flight of the projectile. The gas generator assembly 60 substantially eliminates the occurrence of tail-slap, as will be more fully discussed with reference to FIG. 4.

Figure 4:
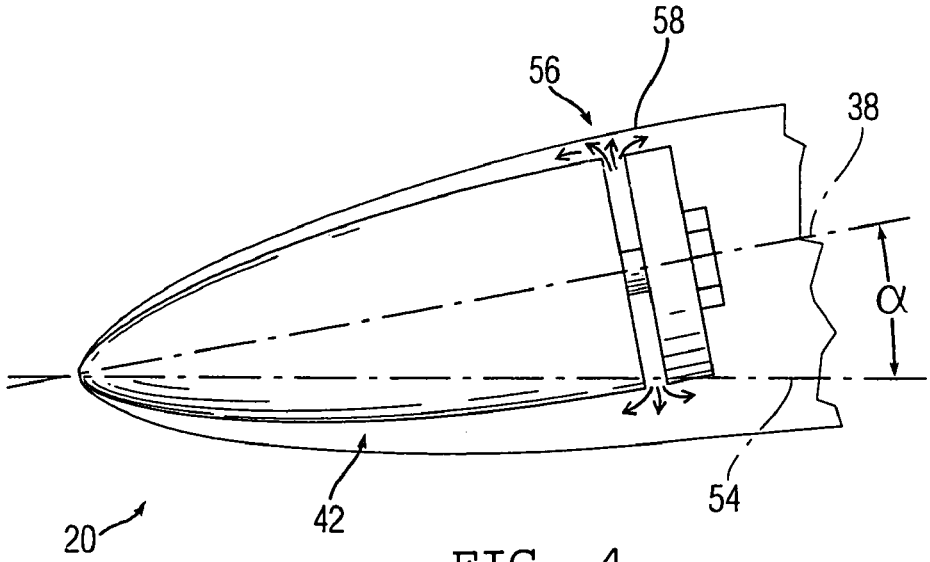
FIG. 4 is a side enclosed view of the projectile and gas generator assembly of FIG. 2 as the projectile travels through fluid in a perturbed state.

FIG. 4 illustrates the projectile 20 of FIG. 2 after the projectile has become perturbed and has begun to yaw, represented by a yaw angle, $\alpha$, measured between the longitudinal axis 38 of the perturbed projectile and a straight-line ideal direction of travel 54. On the side of the projectile 20 that begins to approach a boundary or wall 58 of the vaporous cavity 42, for example, the top side of the projectile 20 with respect to the projectile 20 shown in FIG. 4, discharging gases 56 can act to push against the wall 58 of the cavity 42. At the same time, the pressure on that side of the projectile 20 can increase due to a reduction of size of the area that the gases can discharge into. Reactive forces can form on the wall 58 of the cavity 42 to create a cushion or buffer between the wall of the cavity and the body of the projectile 20. This cushion or buffer acts to push the projectile 20 back towards a restored, straight-line direction of travel 54.

The gas generator assembly 60 allows reactive restoring forces to be generated around the entire circumference of the projectile 20. As a result, tail-slap or the rattling of the projectile 20 back and forth between the walls of the vaporous cavity can be substantially reduced or eliminated. Ideal straight-line travel of the projectile 20 can be restored irrespective of the direction of the perturbances experienced by the projectile.

Moreover, the gas generator assembly 60 operates to efficiently inflate the vaporous cavity 42 by discharging gases into a downstream end of the cavity. Discharging gases into the downstream end of the cavity increases an internal pressure within the entire cavity thereby artificially enlarging the cavity and enhancing the performance of the projectile. An artificially enlarged vaporous cavity 42 allows the projectile to experience less drag and allows the use of a smaller tip cavitator. An artificially enlarged vaporous cavity 42 also allows the projectile to travel more efficiently at lower speeds and at greater depths.

A method of stabilizing a moving projectile is also provided. The method includes providing the gas generator assembly 60 on the rear end portion 36 of the projectile 20. The gas generator assembly 60 defines the at least one radial discharge aperture 48 that can be arranged in fluid communication with the combustion chamber 46. A gas generated by igniting the combustible material 50 arranged in the combustion chamber 46 is discharged from the combustion chamber through the least one radial discharge aperture 48 to an area that is exterior to the body 30 of the projectile 20. The discharged gas is directed to impinge against the wall 58 of the cavity 42 formed by the moving projectile 20 to form a reactive force that stabilizes the projectile.

Those skilled in the art can appreciate from the foregoing description that the present teachings can be implemented in a variety of forms. Therefore, while these teachings have been described in connection with particular embodiments and examples thereof, the true scope of the present teachings should not be so limited. Various changes and modifications may be made without departing from the scope of the teachings herein.

What is claimed is:

1. A projectile comprising:

a body including a front tip portion and a rear end portion;

a combustion chamber base plate operatively connected with and aligned to said rear end portion along a longitudinal axis wherein said combustion chamber base plate is fastened to said rear end portion;

a combustion chamber defined by said combustion chamber base plate as a rear section of said combustion chamber and said rear end portion of said body as a forward section of said combustion chamber with said combustion chamber capable of containing a combustible material; and at least one radial discharge aperture fluidly connected to said combustion chamber wherein said at least one radial discharge aperture is defined by said combustion chamber base plate and said rear end portion such that said at least one radial discharge is on a side of said rear end portion opposite of said front tip portion and such that said at least one radial discharge is within twenty percent of the body at a rear of said body wherein said at least one radial discharge aperture is an annular-shaped slot formed circumferentially about said rear end portion of said body with said at least one radial discharge aperture capable of allowing discharge of a gas that would be generated by igniting the combustible material.

* * * * *